US012221854B2

(12) United States Patent
Karakaya et al.

(10) Patent No.: US 12,221,854 B2
(45) Date of Patent: Feb. 11, 2025

(54) WELLBORE CHEMICAL INJECTION WITH TUBING SPOOL SIDE EXTENSION FLANGE

(71) Applicant: Saudi Arabian Oil Company, Dhahran (SA)

(72) Inventors: Mustafa Karakaya, Dhahran (SA); Sohrat Baki, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/180,651

(22) Filed: Mar. 8, 2023

(65) Prior Publication Data

US 2024/0301766 A1 Sep. 12, 2024

(51) Int. Cl.
*E21B 34/02* (2006.01)
*E21B 33/03* (2006.01)
*E21B 33/068* (2006.01)

(52) U.S. Cl.
CPC ..... *E21B 34/02* (2013.01); *E21B 33/03* (2013.01); *E21B 33/068* (2013.01)

(58) Field of Classification Search
CPC ..... E21B 33/068; E21B 34/02; E21B 33/03; E21B 33/0353; E21B 33/038
See application file for complete search history.

(56) References Cited

U.S. PATENT DOCUMENTS 3,010,023 A * 11/1961 Egan ..... E21B 47/11 73/152.05
3,412,798 A 11/1968 Gregston
3,583,416 A 6/1971 Nebesnik et al.
4,184,504 A 1/1980 Carmichael et al.
4,347,899 A 9/1982 Weeter
6,408,947 B1 6/2002 Cunningham et al.
6,470,971 B1 10/2002 Bridges
6,695,049 B2 2/2004 Ostocke et al.
8,181,700 B2 5/2012 Baugh
8,191,622 B2 6/2012 Comeaux et al.
8,235,066 B2 8/2012 Dalibey et al.
8,684,073 B2 4/2014 Sevheim et al.
8,746,345 B2 6/2014 Kotrla et al.
(Continued)

FOREIGN PATENT DOCUMENTS

CA 3103137 11/2019
GB 2594589 11/2021
WO WO 2019222857 11/2019

*Primary Examiner* — Brad Harcourt
(74) *Attorney, Agent, or Firm* — Fish & Richardson P.C.

(57) ABSTRACT

A wellbore chemical injection assembly includes an extension flange including two ends joined by a flange wall defining an inlet. The first end can fluidically couple to a tubing spool inlet of a wellhead installed at a wellbore surface. The second end can fluidically couple to a fluidic outlet of the wellhead. An extension member is attached to the flange wall at the inlet at a non-zero angle. An axial length of the extension member defines a through opening of increasing inner diameter from the inlet towards an end of the extension member. The end can be fluidically coupled to a chemical reservoir from which chemical is injected through the extension member and the extension flange into the tubing spool. Multiple valves are seated in the through opening of the extension member. The multiple valves are sized differently to seal the through opening of increasing diameter.

14 Claims, 17 Drawing Sheets

(56) References Cited

U.S. PATENT DOCUMENTS

| | | | | |
|---|---|---|---|---|
| 8,899,254 | B1 | 12/2014 | Weiler | |
| 9,217,322 | B2 | 12/2015 | Kleppa | |
| 9,500,062 | B2 | 11/2016 | Tveiten et al. | |
| 9,759,333 | B2 | 9/2017 | Munetomo et al. | |
| 10,400,545 | B2 | 9/2019 | Shirley et al. | |
| 10,450,821 | B2 | 10/2019 | Guedes et al. | |
| 10,502,021 | B2 | 12/2019 | Healy | |
| 11,236,571 | B2 | 2/2022 | Kleppa | |
| 11,261,978 | B2 | 3/2022 | Pivowar et al. | |
| 11,287,058 | B2 | 3/2022 | Horikawa et al. | |
| 11,352,882 | B2 | 6/2022 | Gray et al. | |
| 11,454,086 | B2 | 9/2022 | Harestad | |
| 11,525,530 | B2 | 12/2022 | Borawski et al. | |
| 11,834,925 | B2 | 12/2023 | Alamer et al. | |
| 11,913,300 | B1 | 2/2024 | Karakaya et al. | |
| 11,976,534 | B2 | 5/2024 | Guidry et al. | |
| 12,006,782 | B2 | 6/2024 | Alamer et al. | |
| 2004/0154790 | A1* | 8/2004 | Cornelssen | E21B 33/03 166/75.13 |
| 2006/0107978 | A1* | 5/2006 | Saik | E21B 43/34 134/184 |
| 2011/0108275 | A1 | 5/2011 | Borak et al. | |
| 2016/0326838 | A1* | 11/2016 | Porter | E21B 17/02 |
| 2017/0184228 | A1* | 6/2017 | Kotrla | E21B 33/06 |
| 2018/0010420 | A1 | 1/2018 | Shirley et al. | |
| 2018/0179854 | A1 | 6/2018 | Healy | |
| 2019/0284900 | A1* | 9/2019 | Harestad | E21B 34/02 |
| 2020/0165898 | A1 | 5/2020 | Shirley et al. | |
| 2021/0102437 | A1 | 4/2021 | Sorensen | |
| 2021/0285302 | A1 | 9/2021 | Dalinger et al. | |
| 2022/0170342 | A1 | 6/2022 | Harestad | |
| 2022/0170343 | A1 | 6/2022 | Brodie et al. | |
| 2024/0035350 | A1 | 2/2024 | Alamer et al. | |
| 2024/0229588 | A1 | 7/2024 | McKeon et al. | |

* cited by examiner

WELLBORE CHEMICAL INJECTION WITH TUBING SPOOL SIDE EXTENSION FLANGE

TECHNICAL FIELD

This disclosure relates to wellbore chemical injection and specifically to injection from a surface of the wellbore through a wellhead.

BACKGROUND

Wellbore operations utilize well tools installed within a wellbore formed in a subterranean zone (e.g., a formation, a portion of a formation, multiple formations). Fluids (e.g., drilling mud) used during wellbore formation or hydrocarbons (e.g., petroleum, natural gas, combinations of them) produced through the wellbore after formation and completion can corrode the well tools. Chemicals, such as corrosion inhibitors, scale inhibitors, emulsion preventive inhibitors, asphaltene inhibitor, to name a few, can be injected from a surface of the wellbore into the wellbore (e.g., into a wellbore-tubing annulus) to minimize such corrosive effect of fluids that flow through the wellbore. The chemicals can be injected using a chemical injection assembly that is installed at the surface of the wellbore. The chemical injection assembly can be fluidically coupled to the wellhead, specifically to the wellhead to inject the chemicals through a tubing spool, which is a component of the wellhead.

SUMMARY

This disclosure relates to wellbore chemical injection flange system through tubing spool side outlet port.

Certain aspects of the subject matter described here can be implemented as a wellbore chemical injection assembly. The assembly includes an extension flange including a first end and a second end opposite the first end. The extension flange includes a flange wall between the first end and the second end. The extension flange defines an inlet on the flange wall. The first end can fluidically couple to a tubing spool inlet of a wellhead installed at a surface of a wellbore formed through a subterranean zone. The second end can fluidically couple to a fluidic outlet of the wellhead. The assembly includes an extension member attached to the flange wall at the inlet at a non-zero angle with respect to the flange wall. An axial length of the extension member defines a through opening of increasing inner diameter from the inlet towards an end of the extension member. The end can be fluidically coupled to a chemical reservoir from which chemical is injected through the extension member and the extension flange into the tubing spool. Multiple valves are seated in the through opening of the extension member. The multiple valves are sized differently to seal the through opening of increasing diameter.

An aspect combinable with any other aspect includes the following features. The extension member is perpendicular to the flange wall.

An aspect combinable with any other aspect includes the following features. The opening is formed equidistantly from the first end and the second end.

An aspect combinable with any other aspect includes the following features. The multiple valves include a first valve having a first outer diameter installed in a portion of the through opening near the inlet. The portion at which the first valve is installed has a first inner diameter. The multiple valves include a second valve having a second diameter greater than the first diameter and installed in a portion of the through opening having a second inner diameter greater than the first inner diameter. The first valve is installed between the second valve and the inlet. The multiple valves include a third valve having a third diameter greater than the second diameter and installed in a portion of the through opening having a third inner diameter greater than the second inner diameter. The third valve is installed between the end of the extension member and the second valve.

An aspect combinable with any other aspect includes the following features. Each of the multiple valves is removably installed within the extension member.

An aspect combinable with any other aspect includes the following features. The end of the extension member includes a face. The face defines profiles to couple the extension member to a pressure lubricator that can remove the multiple valves from within the extension member.

Certain aspects of the subject matter described here can be implemented as a method. An extension member is attached to an inlet in a flange wall between a first end and a second, opposite end of an extension flange. The extension member is attached at a non-zero angle with respect to the flange wall. An axial length of the extension member defines a through opening from the inlet to the end of the extension member. The extension flange defines a flow pathway from the first end to the second end. The flow pathway can receive fluid through the extension member. Multiple valves are installed in the through opening of the extension member. The first end of the extension flange is coupled to a tubing spool inlet of a wellhead installed at a surface of a wellbore formed through a subterranean zone. Chemicals are injected through the extension member and the inlet into the wellbore through the tubing spool inlet.

An aspect combinable with any other aspect includes the following features. To install the multiple valves in the through opening, the through opening is formed to increasing inner diameters from the inlet towards the end of the extension member.

An aspect combinable with any other aspect includes the following features. To install the multiple valves, a first valve, which has a first outer diameter in a portion of the through opening near the inlet, is installed. The portion at which the first valve is installed has a first inner diameter. A second valve, which has a second diameter greater than the first diameter, is installed in a portion of the through opening having a second inner diameter greater than the first inner diameter. The first valve is installed between the second valve and the inlet. A third valve, which has a third diameter greater than the second diameter is installed in a portion of the through opening having a third inner diameter greater than the second inner diameter. The third valve is installed between the end of the extension member and the second valve.

An aspect combinable with any other aspect includes the following features. A chemicals leak is determined in the multiple valves. In response, injecting the chemicals is ceased. The multiple valves are removed from within the extension member.

An aspect combinable with any other aspect includes the following features. To remove the multiple valves from within the extension member, a pressure lubricator is coupled to an end face of the end of the extension member. The multiple valves are removed by operating the pressure lubricator.

An aspect combinable with any other aspect includes the following features. The second end of the extension flange is coupled to a fluidic outlet of the wellhead.

An aspect combinable with any other aspect includes the following features. To inject the chemicals through the extension member and the inlet into the wellbore through the tubing spool inlet, the fluidic outlet of the wellhead is closed before injecting the chemicals.

An aspect combinable with any other aspect includes the following features. The fluidic outlet of the wellhead includes multiple gate valves. To close the fluidic outlet, the gate valves are closed.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1A:
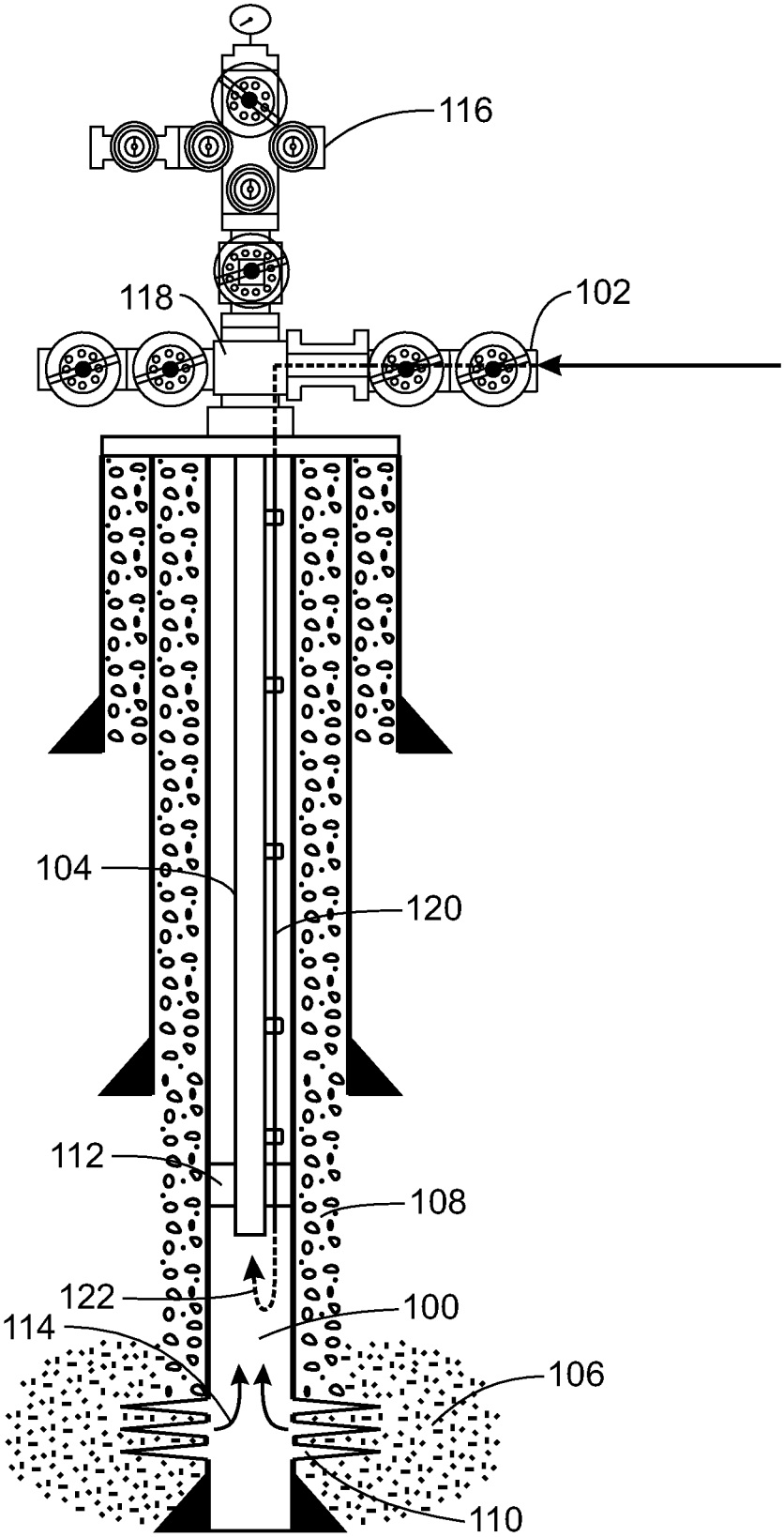
FIGS. 1A, 1B and 1C are examples of different arrangements to inject chemicals into a wellbore using the wellbore injection assembly described in this disclosure.

Hydrocarbons entrapped in subsurface reservoirs flow from the reservoirs through the subterranean zone into the wellbore formed in the subterranean zone. Wellbore equipment are installed within the wellbore to produce the hydrocarbons to the surface. The fluids, e.g., high saline formation brines, various mixtures of oil and mixtures of gas (such as natural gas, hydrogen sulfide, carbon dioxide) that flow into the wellbore through the subterranean zone are extremely corrosive. The wellbore equipment, e.g., tubulars, packers, and the like, can be adversely impacted by the long-term contact with such fluids. For example, the equipment can corrode, or scales or sludges can build up on the equipment or both. The adverse impact on the wellbore equipment, in turn, can impact well production, well integrity, surface production facilities and the like. The adverse impact of the wellbore fluids can be reduced by flowing (i.e., injecting or pumping) chemical inhibitors into the wellbore. The chemicals can be pumped from a surface of the wellbore continuously to downhole locations, specifically to the area of the designed target depth.

This disclosure describes a wellbore chemical injection assembly with an extension flange that can be coupled to a tubing spool inlet of a wellhead of a wellbore formed in a subterranean zone. In some implementations, the assembly includes a mandrel with a thread profile that can be coupled to a counterpart thread profile formed in the tubing spool inlet. The mandrel is installed within the extension flange. The extension flange is a flange that has a similar/same type of pressure rating and connection type for a gate valve connection. The extension flange is designed and constructed to swallow mandrel/seat together while also allowing the injection valve to pass through. The extension flange allows increasing the space between the gate valve and tubing spool side outlet flange.

A valve seat is installed within the mandrel, and a valve set including check valves is installed within the valve seat. The assembly is fluidically coupled to the wellhead such that the mandrel forms a metal-to-metal seal with the tubing spool inlet (e.g., a side outlet port), and the valve seat forms a fluidic seal within the mandrel. Chemicals can be injected into the wellhead through the extension flange. If a leak is detected at the tubing spool inlet-mandrel interface, then the assembly can be detached from the wellhead at the mandrel, and the mandrel alone can be replaced. If a leak is detected in the valve seat-mandrel interface, then the valve seat alone can be replaced. If the injection valve leaks, then the injection valve can be replaced. All these replacements can be done directly if wellhead does not have any positive pressure or can be done through VR plug lubricator systems if the well is under pressure.

In some implementations, the assembly includes an extension flange with an inlet formed on a flange wall (i.e., a side wall that connects an inlet and an outlet). An extension member extends from the flange wall inlet away from the flange wall. A valve seat is installed within the extension member, and a valve set including check valves is installed within the valve seat. In this implementation, there is no thread connection for the valve seat. Instead, the valve seat are included in the body of the chemical injection flange. The flange body has three different sized seats (threads). Each check valve can be installed or removed independently. Deeper check valve seat is smaller in size (near the flange main inner bore). Outer check valve is comparatively bigger. The assembly is fluidically coupled to the wellhead such that chemicals can be injected through the tubing spool inlet. In particular, the chemicals are injected in a direction that is transverse to the end-to-end opening within the extension flange. If a leak is detected in the valve seat-extension member interface, then the valves can be replaced.

Implementations of the subject matter described in this disclosure can improve efficiency and safety of wellbore chemical injection operations by deploying internal fail safe systems. The techniques described here are mechanical solutions that can be deployed with lesser resource consumption compared to smart solutions that implement pneumatic, hydraulic or electrical actuators. The techniques can also increase well integrity in instances that do not require chemical injection from the surface for a duration of time. The arrangement allows chemical injection while keeping side outlet barriers in place and in closed position, while keeping side outlet gate valves in closed position. The arrangement of the valve seat allows easy removal of valves to perform operations such as killing the well, injecting high density brine fluid or performing higher rate injection operations. The assembly can serve as a barrier that facilitates replacing gate valves on the side outlet of the tubing spool. Replacing the mandrel can be performed using valve removal (VR) lubricators.

Figure 1B:
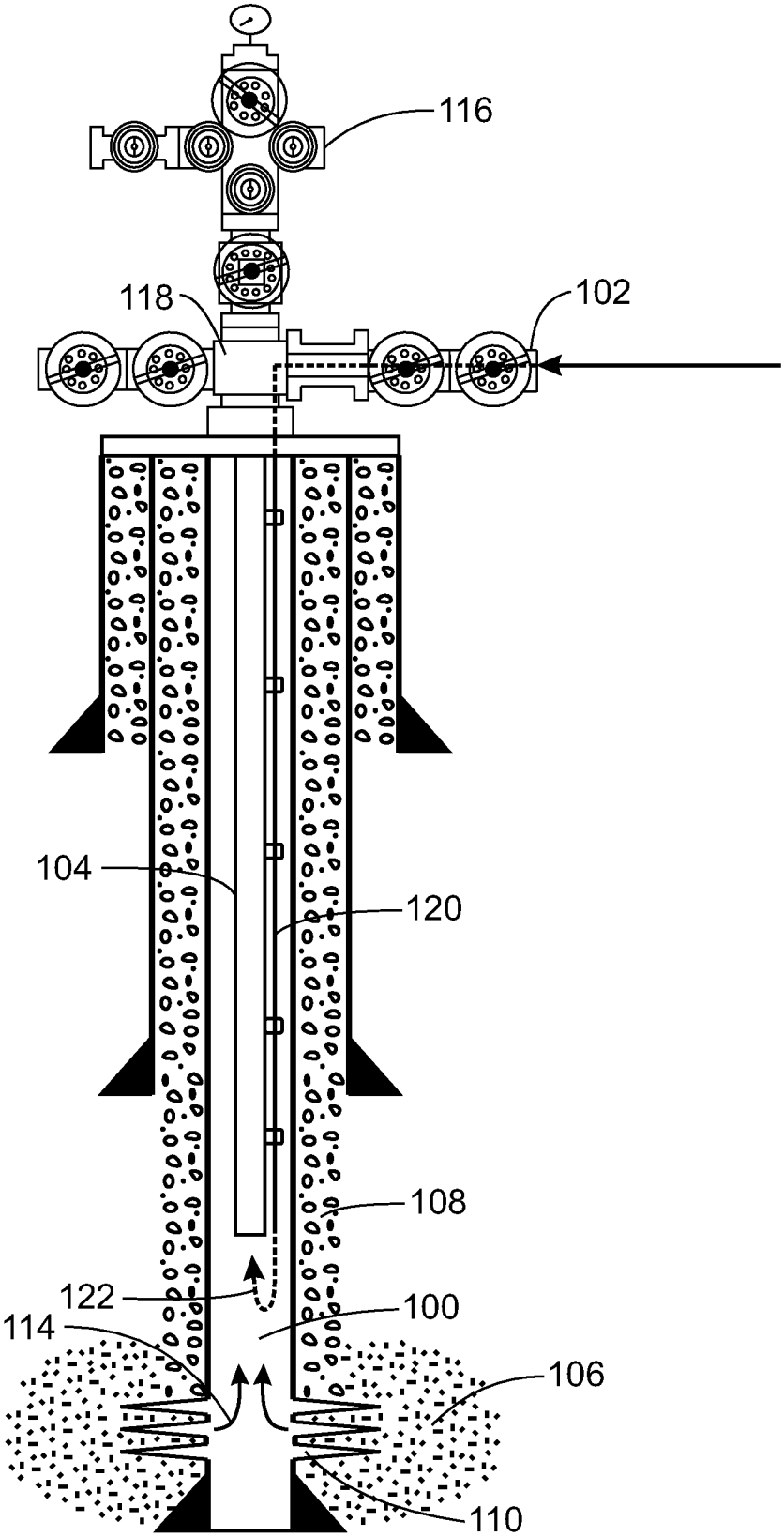
Figure 1C:
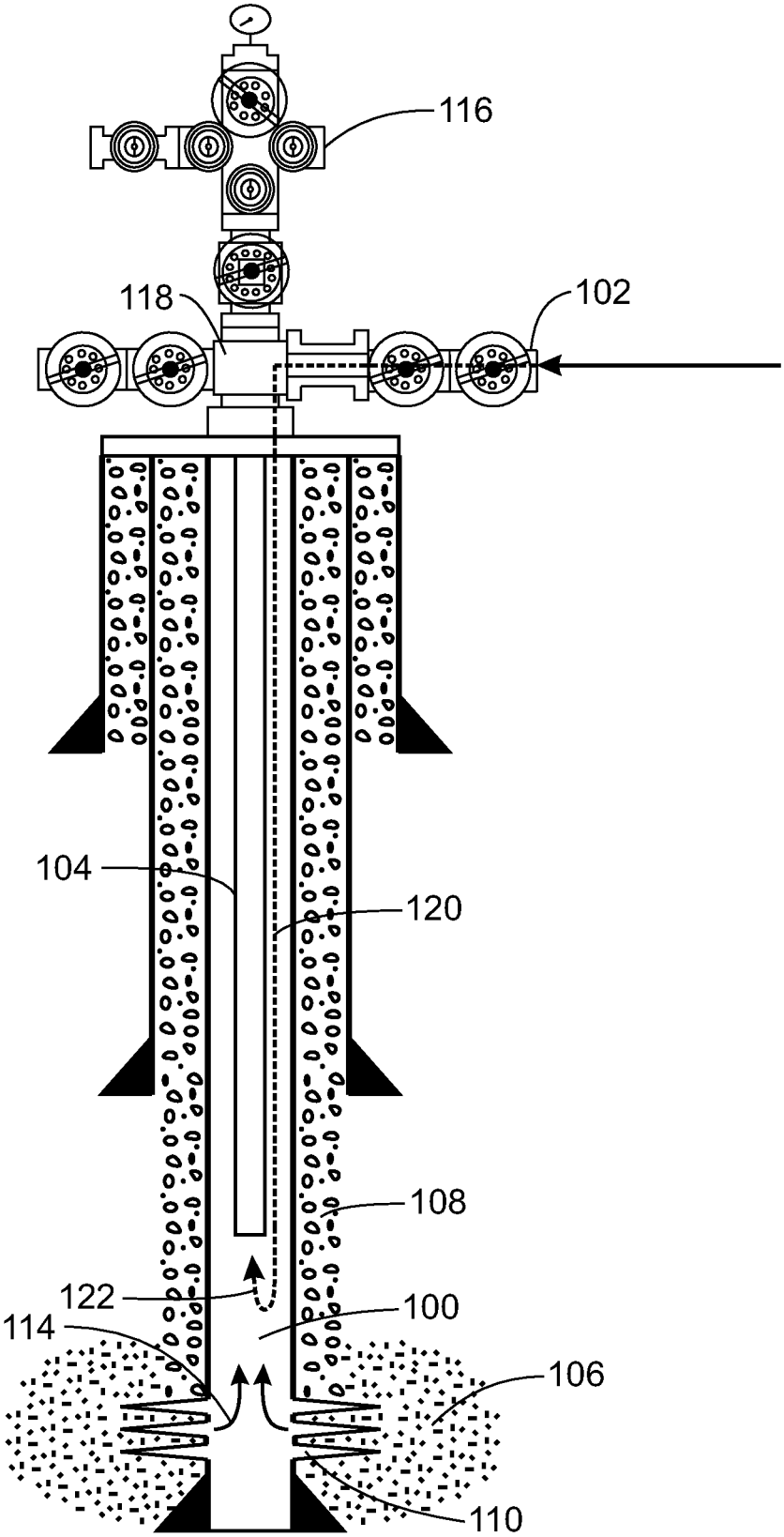

FIGS. 1A, 1B and 1C are examples of different arrangements to inject chemicals into a wellbore 100 using the wellbore injection assembly 102 described in this disclosure. The arrangements can be implemented to inject chemicals into a tubing annulus to transfer the chemicals to downhole locations within the wellbore 100. FIG. 1A shows a schematic arrangement of using the assembly 102 to inject chemicals into a downhole location in the wellbore 100 for flow in an uphole direction through a production tubing 104 to the surface. The wellbore 100 is formed in a subterranean zone 106. The wellbore 100 can be cased and cemented 108 or can be non-cement cased or partially cased. Perforations 110 formed in the wellbore wall allow hydrocarbons to flow from the subterranean zone 106 into the wellbore 100. Packers 112 can be installed near a downhole end of the production tubing 104 to isolate a region of the wellbore 100 below the packers 112 from a region above the packers 112. The hydrocarbons flow from the subterranean zone 106 in an uphole direction (arrows 114) towards a downhole inlet of the production tubing 104 and towards the surface of the wellbore 100.

At the surface, a wellhead can be installed to deploy wellbore equipment (including the production tubing 104, the packers 112, etc.) within the wellbore 100, and also to serve as a connection point for surface equipment. The wellhead can include a wellhead 116, which is a network of fluidic inlets, outlets and flow control equipment (such as valves) to which the wellbore injection assembly 102 is fluidically coupled. In particular, the assembly 102 can be fluidically coupled to an inlet formed in a tubing spool 118 of the wellhead 116. A control line 120 (e.g., a tubing or a pipe) extends from the tubing spool 118 to a downhole location that is downhole of the inlet to the production tubing 104. For example, the control line 120 can pass through an annulus formed by the production tubing 104 and the casing installed in or inner wall of the wellbore 100, and through the packers 112. Chemicals can be injected from the surface of the wellbore 100 through the control line 120 to the downhole location. The injected chemicals are flowed in an uphole direction (arrows 122) by the hydrocarbons and swept into the production tubing 104. As the chemicals flow towards the surface, the chemicals contact the wellbore equipment (such as the inner walls of the production tubing 104) to prevent, reduce or reverse the adverse effects mentioned earlier.

FIG. 1B shows another schematic arrangement of using the assembly 102 to inject chemicals into a downhole location in the wellbore 100 for flow in an uphole direction through a production tubing 104 to the surface. The arrangement of FIG. 1B is substantially identical to that of FIG. 1A, except that the arrangement of FIG. 1B does not implement the packers 122 (FIG. 1A). The arrangement of FIG. 1B allows monitoring annulus pressure behind the production tubing 104, which helps to monitor liquid loading condition of the wellbore 100. FIG. 1C shows another schematic arrangement of using the assembly 102 to inject chemicals into a downhole location in the wellbore 100 for flow in an uphole direction through a production tubing 104 to the surface. The arrangement of FIG. 1C is substantially identical to that of FIG. 1A, except that the arrangement of FIG. 1C does not implement the control line 120 and does not implement packers. Instead, the chemicals are injected from the surface, through the tubing spool 118, directly into the annulus. The chemicals will travel downhole through the annulus and enter the production tubing 104 with the hydrocarbons. The wellbore chemical injection assembly 102 can be used to inject chemicals in any of the arrangements shown in FIGS. 1A-C or other arrangements in which wellbore equipment installed within a wellbore needs to be treated with chemicals injected from the surface.

Figure 2:
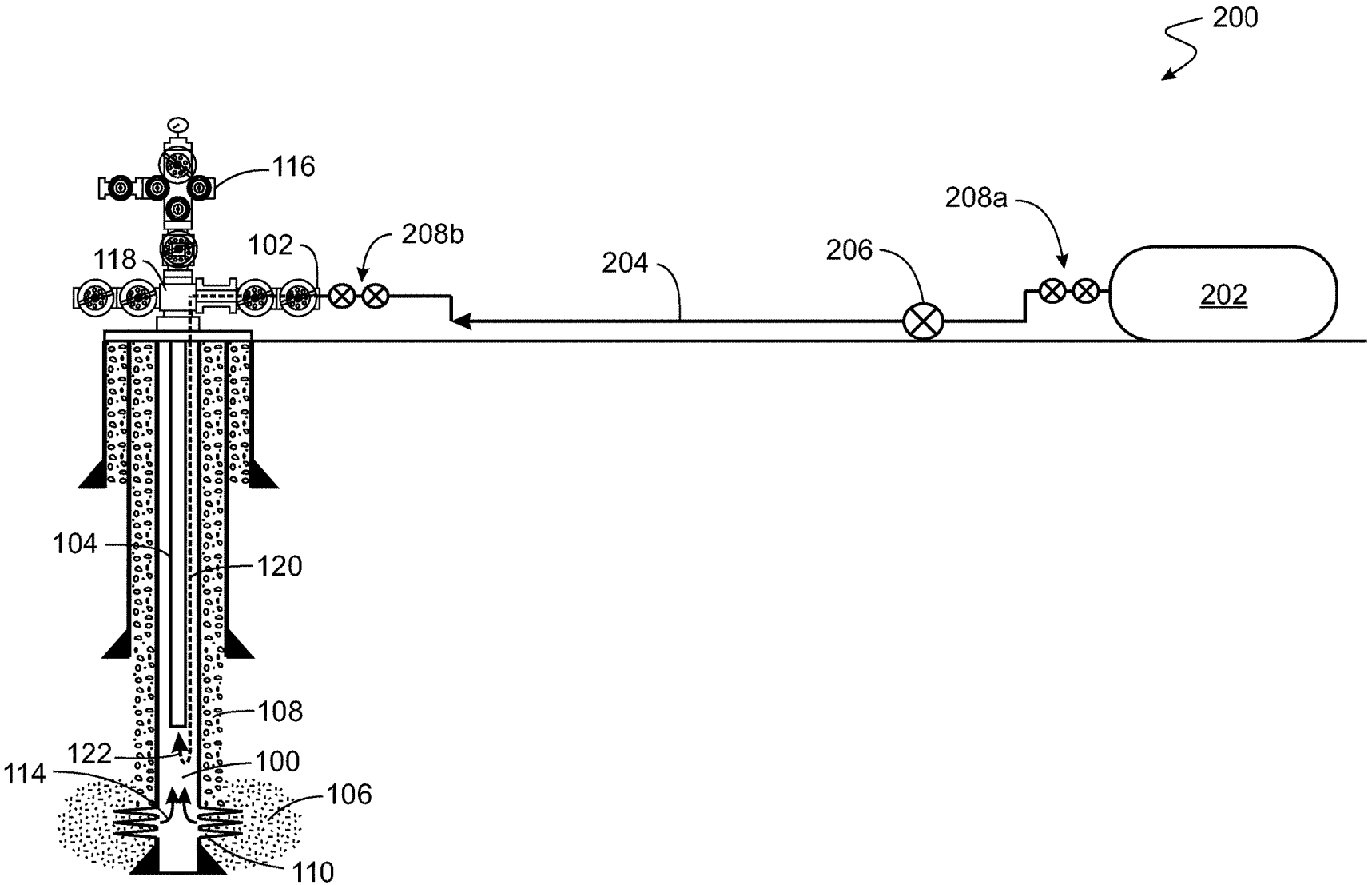
FIG. 2 shows a schematic diagram of a wellbore chemical injection system disposed at a surface of a wellbore.

FIG. 2 shows a schematic diagram of a wellbore chemical injection system 200 disposed at a surface of the wellbore 100. The system 200 is shown as being implemented with the wellbore 100 described with reference to FIG. 1C. However, the system 200 is useable with any of the arrangements shown in FIGS. 1A, 1B and 1C or other arrangements in which wellbore equipment need chemical treatment. The system 200 includes a chemical reservoir 202 (e.g., a tank) that stores the chemical or chemicals to be injected into the wellbore 100. A chemical line 204 (e.g., tubing or pipe) fluidically couples the reservoir 202 to the wellbore injection assembly 102. Flow through the chemical line 204 is implemented using a pump 206 (e.g., a high pressure pump) and flow control equipment (e.g., control valves 208*a*, 208*b*) fluidically coupled along the length of the chemical line 204. One or more of the control valves (e.g., control valves 208*b*) can be installed near and fluidically coupled to the wellbore chemical injection assembly 102. The assembly 102 is fluidically coupled to an inlet of the tubing spool 118 of the wellhead 116.

As described later, the assembly 102 and the tubing spool inlet are coupled using valve removal (VR) plugs. The VR plugs have an American Petroleum Institute (API) Sharp Vee VR profile (called "Sharp Vee") profile that is rated for pressures between 3,000 pounds per square inch (psi) and 10,000 psi. Tubing spools have API standard VR plug profiles. VR plugs do not stay in installed positions in the side outlet ports at all times. In some situations, the VR plugs can be installed and kept in the wellhead. If the VR standard VR plug is installed, they fully isolate the side outlet port.

Figure 3A:
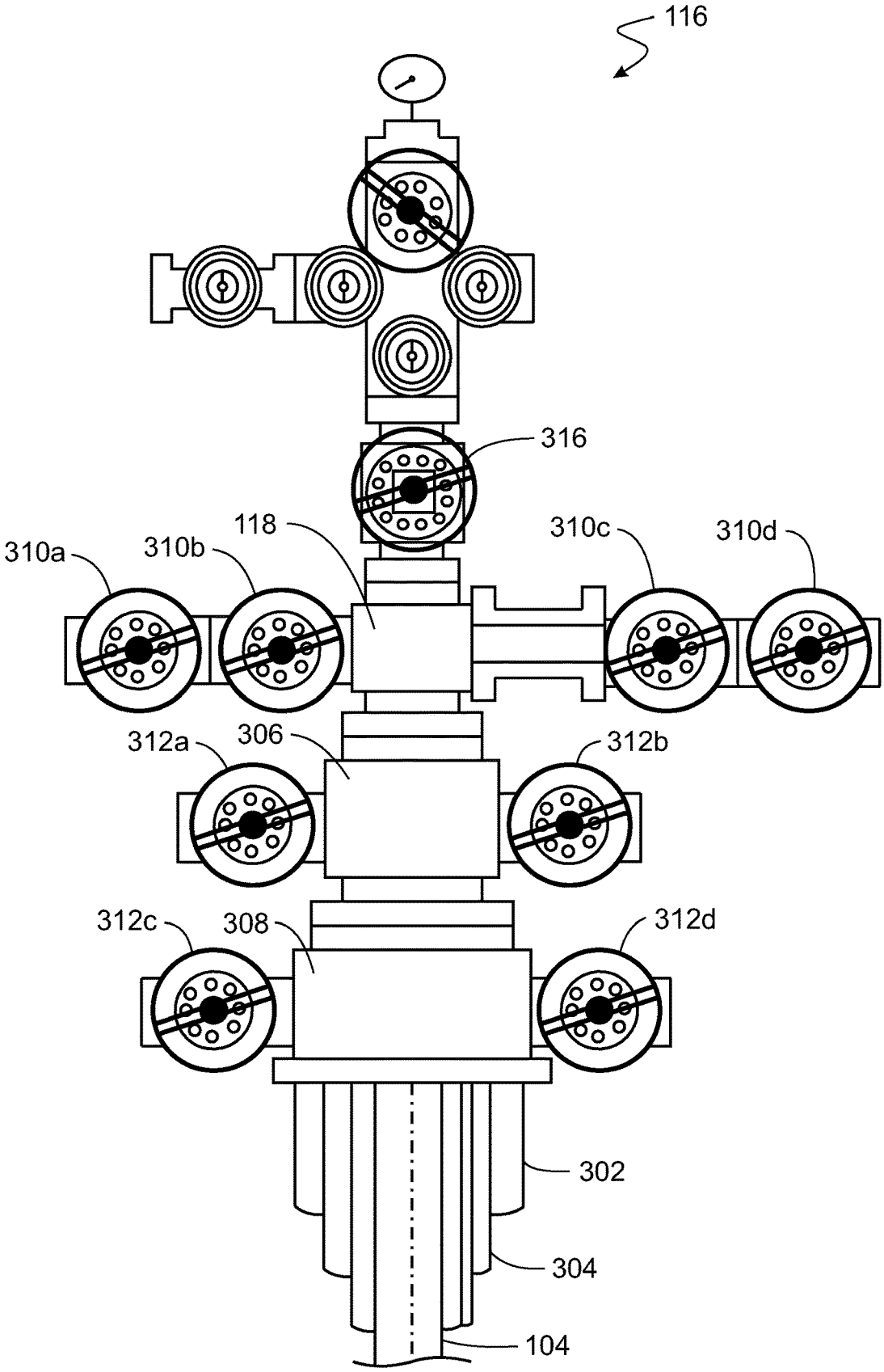
FIG. 3A is a schematic diagram of a wellhead including a tubing spool to which a first implementation of a wellbore chemical injection system is connected.

FIG. 3A is a schematic diagram of a wellhead 116 including a tubing spool 118 to which a first implementation of a wellbore chemical injection system is connected. The wellhead 116 can be attached to different types of tubings installed within the wellbore, e.g., a surface casing 302, an intermediate casing 304, the production tubing 104. The wellhead 116 can include multiple spools including a top tubing spool 118, a first casing spool 306 and a second casing spool 308. Each spool can be fluidically coupled to one of the tubings or casing installed within the wellbore 100. The top tubing spool 118 can be fluidically coupled to the production tubing 104. Each spool can be fluidically coupled to respective gate valves, e.g., gate valves 310*a*, 310*b*, 310*c*, 310*d* fluidically coupled to the top tubing spool 118, gate valves 312*a*, 312*b* fluidically coupled to the first casing spool 306, gate valves 312*c*, 312*d* fluidically coupled to the second casing spool 308. The gate valves coupled to the spools can include outlets that can couple to flow equipment (such as tubings) using which fluid flow into or out of the respective spools can be controlled. A production tree 314 is installed above the top tubing spool 118 and can be fluidically coupled to the top tubing spool 118 through a gate valve 316.

Figure 3B:
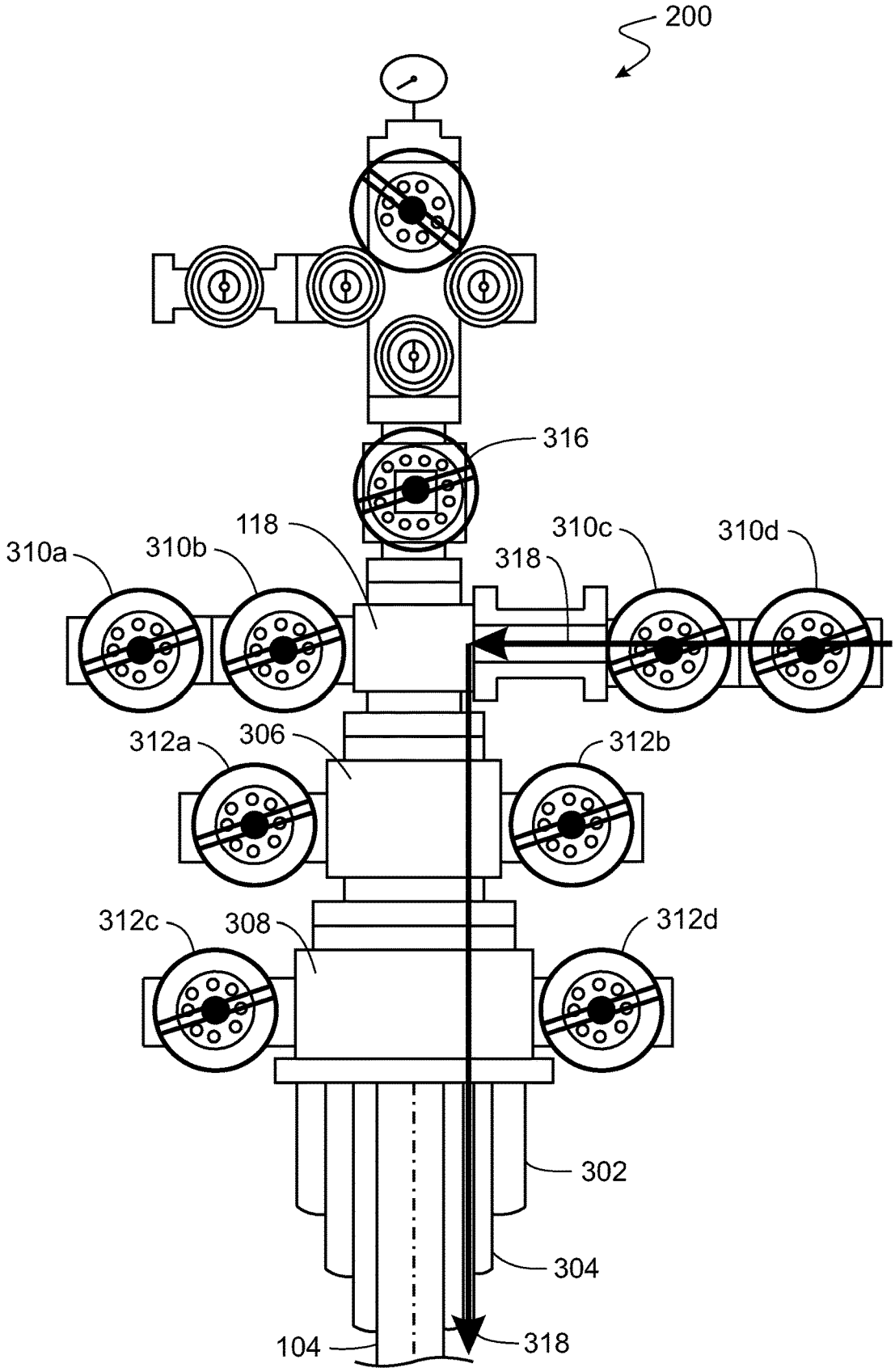
FIG. 3B is a schematic diagram of flowing chemicals through the wellbore chemical injection assembly of FIG. 3A.

In some implementations, the wellbore chemical injection assembly 102 can be fluidically coupled to the top tubing spool 118 between the gate valve 310*c* and an inlet to the tubing spool 118. In alternative implementations, the assembly 102 can be fluidically coupled between the gate valves 310*c* and 310*d*, or the gate valves 310*c* and 310*d* can be fluidically coupled between the assembly 102 and the tubing spool inlet. FIG. 3B is a schematic diagram of flowing chemicals through the wellbore chemical injection assembly of FIG. 3A. Using the wellbore chemical injection assembly 200 (FIG. 2), chemicals from the chemical reservoir 202 (FIG. 2) are flowed through the chemical line 204 (FIG. 2) into the inlet of the tubing spool 118 and into the annulus between the production tubing 104 and the inner wall of the intermediate casing 304, as schematically shown by the arrow 318.

Figure 4A:
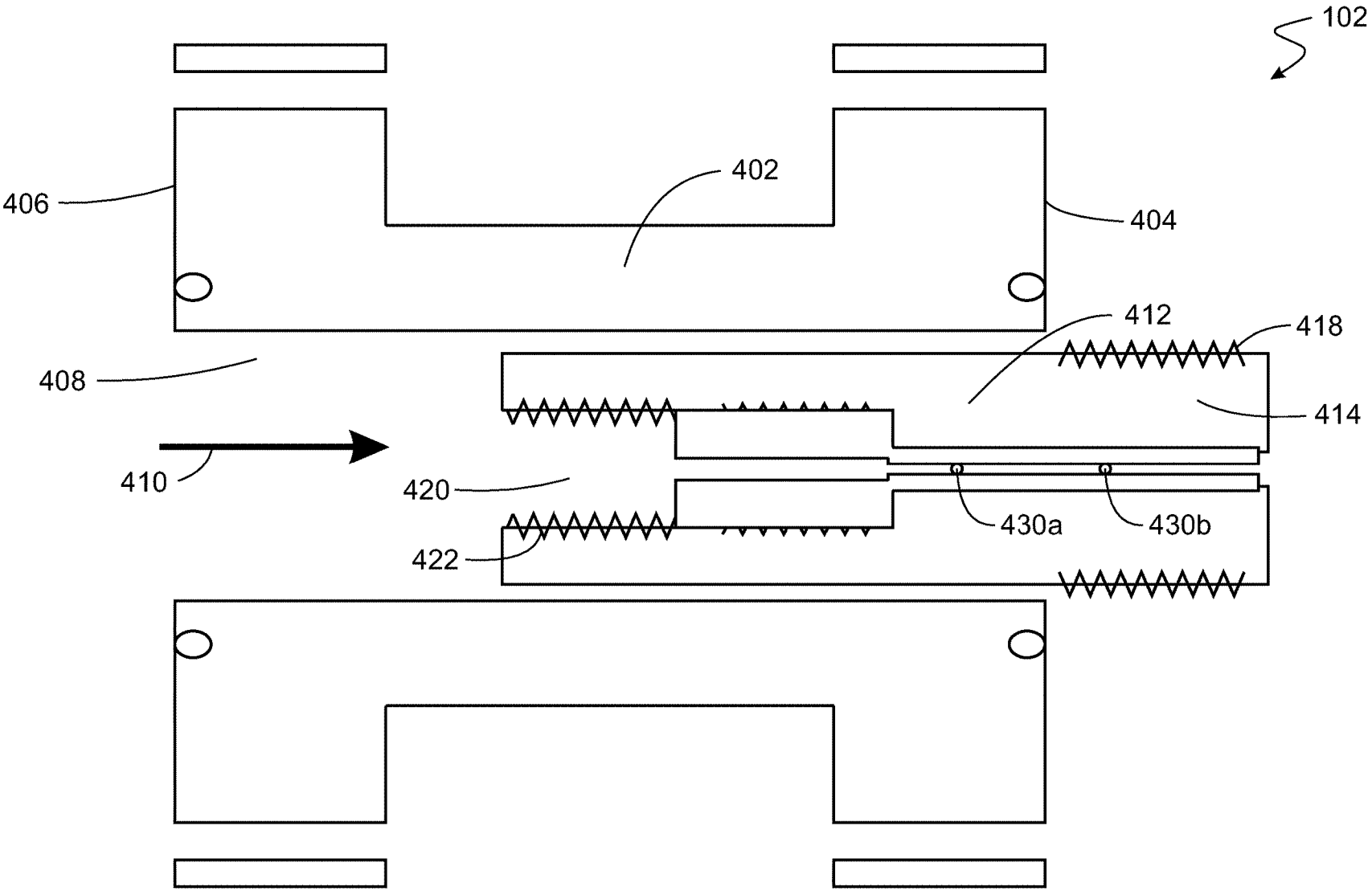
FIG. 4A is a schematic diagram of the wellbore chemical injection assembly implemented in the first implementation.

FIG. 4A is a schematic diagram of the wellbore chemical injection assembly 102 implemented in the first implementation. The assembly 102 includes a flange, mandrel/valve seat and an injection valve. The assembly 102 includes an extension flange 402 having a first end 404 and a second end 406 opposite the first end. The extension flange 402 defines a flange bore 408 between the first end 404 and the second end 406. The flange bore 408 is an open space through which fluid (e.g., chemicals from the chemical tank 202 (FIG. 2)) can flow. The first end 404 is fluidically coupled to an inlet of the tubing spool 118 (FIGS. 1A-1C) of the wellhead 116 (FIGS. 1A-1C). The second end 406 is configured to be fluidically coupled to a chemical reservoir (e.g., the chemical tank 202 (FIG. 2) through the chemical line 204 (FIG. 2)). In some implementations, a gate valve can be installed at the second end 406. Pressure at the tubing spool inlet may necessitate installing one more additional barriers (e.g., gate valves).

Chemicals flowed using the pump 206 (FIG. 2) flow through the assembly 102 by entering the flange bore 408 through the second end 406 and flowing towards the first end 404 as shown by the arrow 410. The ends of the extension flange 402 include openings to secure (e.g., bolt) the extension flange 402 to tubing spool 118 on the first end 404 and to other equipment, e.g., gate valves 310*c*, 310*d* (FIG. 3A), on the second end 406.

The assembly 102 includes a mandrel/valve seat subassembly 412 that includes a mandrel 414 and a valve seat 416. The mandrel 414 is coupled to the tubing spool side outlet port (VR plug profile) negating any direct contact between mandrel/valve seat and extension flange 402. In particular, a portion of the mandrel 414 resides within the flange bore 408. A remainder of the mandrel 414 extends out of the extension flange 402, e.g., past the first end 404. The extension flange 402 covers the mandrel 414.

Figure 4B:
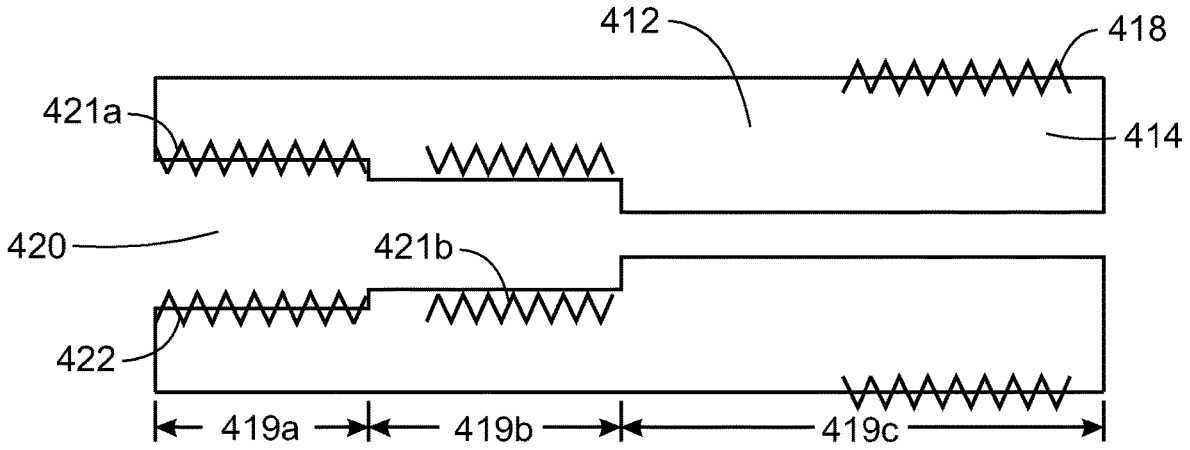
FIG. 4B is a schematic diagram of a mandrel installed within the assembly of FIG. 4A.

FIG. 4B is a schematic diagram of a mandrel installed within the assembly of FIG. 4A. The assembly includes the mandrel or valve seat. The mandrel defines an interior opening 420 that spans an axial length of the mandrel 414. In some implementations, a first length segment of the interior opening 420 has a first inner diameter, and a second length segment (i.e., a remaining of) the interior opening has a second inner diameter smaller than the first inner diameter. In some implementations, the interior opening can have more than two length segments of successively decreasing inner diameters.

Outer coupling threads 418 are formed on an outer surface of the portion of the mandrel 414 that extends out of the flange bore 408 past the first end 404. The outer coupling threads 418 can removably mate with counterpart threads in the tubing spool inlet. By removably couple, it is meant that, when portion of the mandrel 404 with the outer coupling threads is inserted into the portion of the tubing spool inlet with the counterpart threads, the mandrel 404 and the tubing spool inlet form a seal, e.g., a metal-to-metal seal or similar seal that fluidically seals the outer surface of the mandrel 404 to the inner surface of the tubing spool inlet. For example, the outer coupling and counterpart threads can be API standard Sharp Vee threads or ACME threads.

To reverse the mating, the mandrel 414 can be pulled out of the tubing spool inlet, e.g., using a VR plug lubricator system, which can remove the mandrel even when the connection is under fluidic pressure. A VR lubricator system is used to replace valves such as a side outlet valve, annular valve or wing valve on the tubing spool of a wellhead. The VR lubricator system is mounted on the outlet flange of the gate valve (e.g., the gate valve 312*d*) and operated to install/remove the VR plug through the extension flange bore. The VR lubricator system can be operated hydraulically or manually. The VR lubricator system includes a cylinder and an internal rod. The VR lubricator system works by exerting pressure into the cylinder causing the rod to move inward or outward like a hydraulic piston.

In some implementations, the length segment of the interior opening with the smallest inner diameter can also have the outer coupling threads 418 on the outer surface. Conversely, the length segment of the interior opening with the largest inner diameter can have no threads formed on the outer surface. Instead, that length segment can have inner coupling threads 422 formed on an inner surface of the interior opening 420. In the schematic shown in FIG. 4B, the interior opening 420 of the mandrel 414 includes three length segments of decreasing diameter-length segment 419*a*, length segment 419*b*, length segment 419*c*, axially connected to each other to form the axial length of the mandrel 414. The inner surface of the length segment 419*a* includes coupling threads 421*a* (e.g., left-handed ACME threads). The inner surface of the length segment 419*b* includes coupling threads 421*b* (e.g., right-handed ACME threads). The last length segment of the mandrel 414 that connects to the tubing spool inlet (the length segment 419*c* in FIG. 4B) does not have any coupling threads on the inner surface.

Figure 4C:
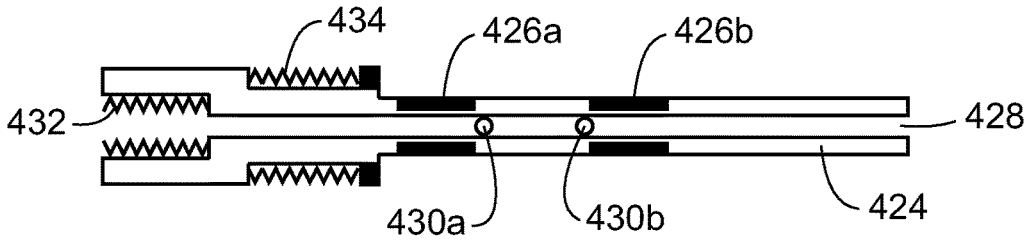
FIG. 4C is a schematic diagram of a valve seat installed within the assembly of FIG. 4A.

FIG. 4C is a schematic diagram of a valve 424 installed within the assembly 102. The assembly includes the injection valve. The valve 424 is a component of a valve assembly installed within the interior opening 420 defined along the axial length of the mandrel 414. The valve 424 has an axial length made up of length segments of different outer diameters, each outer diameter of a valve seat length segment complementing a corresponding inner diameter of a length segment of the mandrel defining an interior opening 420. Thus, when the valve 424 is installed within the interior opening 420, each length segment of the valve 424 fits snugly within a corresponding length segment of the interior opening 420. In addition, each valve seat segment can include seals (e.g., seals 426*a*, 426*b*) to form a fluidic seal between an outer surface of the valve seat segment and the corresponding length segment of the interior opening 420 in which the valve seat segment is installed.

The valve 424 can further define an interior opening 428 through which injected chemicals can flow into the tubing spool inlet. Multiple valves (e.g., two check valves 430*a*, 430*b* (also shown in FIG. 4A) or more check valves) can be installed within the interior opening 428 of the valve 424 to permit injected chemicals to flow towards the tubing spool inlet but not in the opposite direction. The valve 424 can be removably mated to the interior opening 420 of the mandrel 414. To do so, an inner surface of the interior opening 428 in a length segment of the valve seat with the greatest outer diameter (which length segment is farthest from the tubing spool inlet) can include coupling threads 432 (e.g., left-handed ACME threads or other coupling threads) to mate to corresponding threads on the inner surface of the interior opening 420 of the mandrel 414 (e.g., to threads 421*a*). An outer surface of the valve 424 can also include coupling threads 434 (e.g., right-handed ACME threads or other coupling threads) to mate to corresponding threads 421*b* on the interior opening 420 of the mandrel 414. Such coupling forms a fluidic seal between the outer surface of the valve 424 and the inner surface of the interior opening 420. The fluidic seal is strengthened by the sealing elements 426*a*, 426*b*. To de-couple, the valve 424 can be axially pulled out of the interior opening 420.

Figure 5:
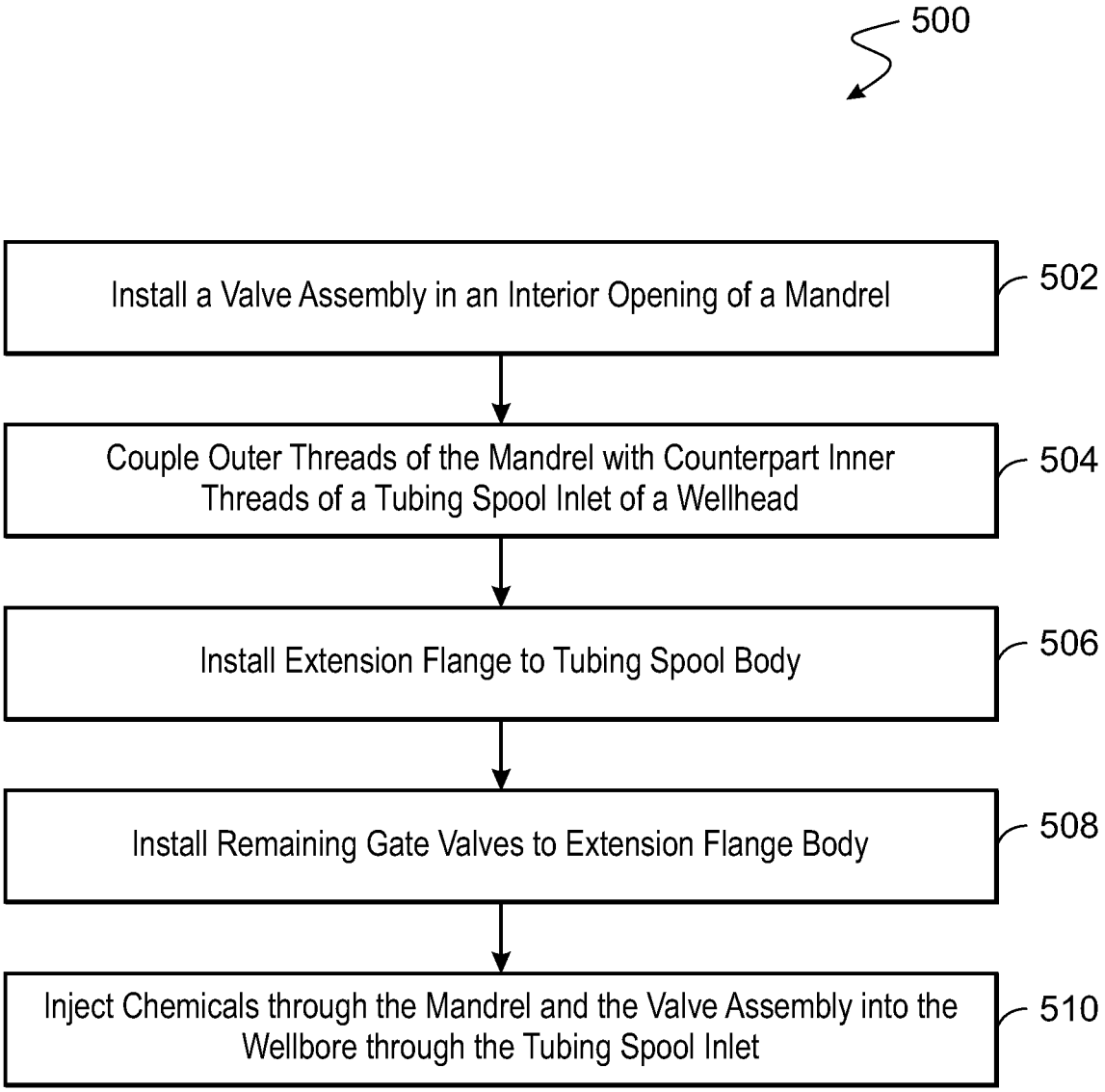
FIG. 5 is a flowchart of an example of a process of implementing the wellbore chemical injection assembly of FIG. 3A.

FIG. 5 is a flowchart of an example of a process 500 of implementing the wellbore chemical injection assembly of FIG. 3A. The process 500 can be implemented by a well operator. At 502, a valve assembly (e.g., the valve assembly including the valve seat 420 with the multiple check valves 430*a*, 430*b*) is inserted into the interior opening 420 that spans the axial length of the mandrel 414. In particular, valve coupling threads (e.g., 434) on an outer surface of a first segment (e.g., the length segment 419*b*) with inner coupling threads (e.g., threads 422) on an inner surface of a portion of the interior opening 420. At 504, the outer coupling threads 418 are coupled with counterpart threads in an inlet of the tubing spool 118 of the wellhead 118 installed at a surface of the wellbore 100. At 506, the flange bore 408 is installed to the tubing spool body. At 508, the remaining gate valves are installed the flange bore 408. As described earlier, the gate valves are installed directly in the tubing spool side outlet port VR profile. The installation can be made through existing tubing spool gate valve inner bore with VR lubricator. The installation can be made directly to tubing spool without any gate valve or extension flange if there is no pressure. If extension sub is previously installed on the tubing spool with one or two gate valves and extension flange with VR plug lubricator, either under pressure or zero pressure. At 510, chemicals are injected through the mandrel 414 and the valve assembly into the wellbore through the tubing spool inlet. In some implementations, the chemicals flow from axial end to axial end along the longitudinal axis of the extension flange 402.

During operation, if a chemicals leak is detected in the valve 424, then the injection of chemicals through the mandrel and the valve assembly is ceased, e.g., by turning off the HP pump 206 (FIG. 2). Then, the valve assembly can be removed from within the interior opening 420 by de-coupling the valve coupling threads (e.g., threads 434) from the inner coupling threads (e.g., threads 418) of the mandrel 414. This operation can be performed with VR plug standard lubricator through gate valve and extension flange. The operation can be performed without requiring to rig down extension flange or any of the gate valves. In particular, the valve assembly can be removed without needing to de-couple the mandrel 414 from the tubing spool 118. Also, during operation, if a chemicals leak is detected in the flange bore 408, then too, the injection of chemicals is ceased. Then, the mandrel 414 is removed from the flange bore 408 while retaining the valve assembly within the interior opening 420. For example, without removing the valve 424 from within the interior opening 420, the extension flange 402 can be separated from the tubing spool 118, and the mandrel 424 can be de-coupled from the tubing spool inlet. In this manner, depending on the location of the leak, a component responsible for the leak can be replaced without needing to replace the entire chemical injection assembly.

Figure 6A:
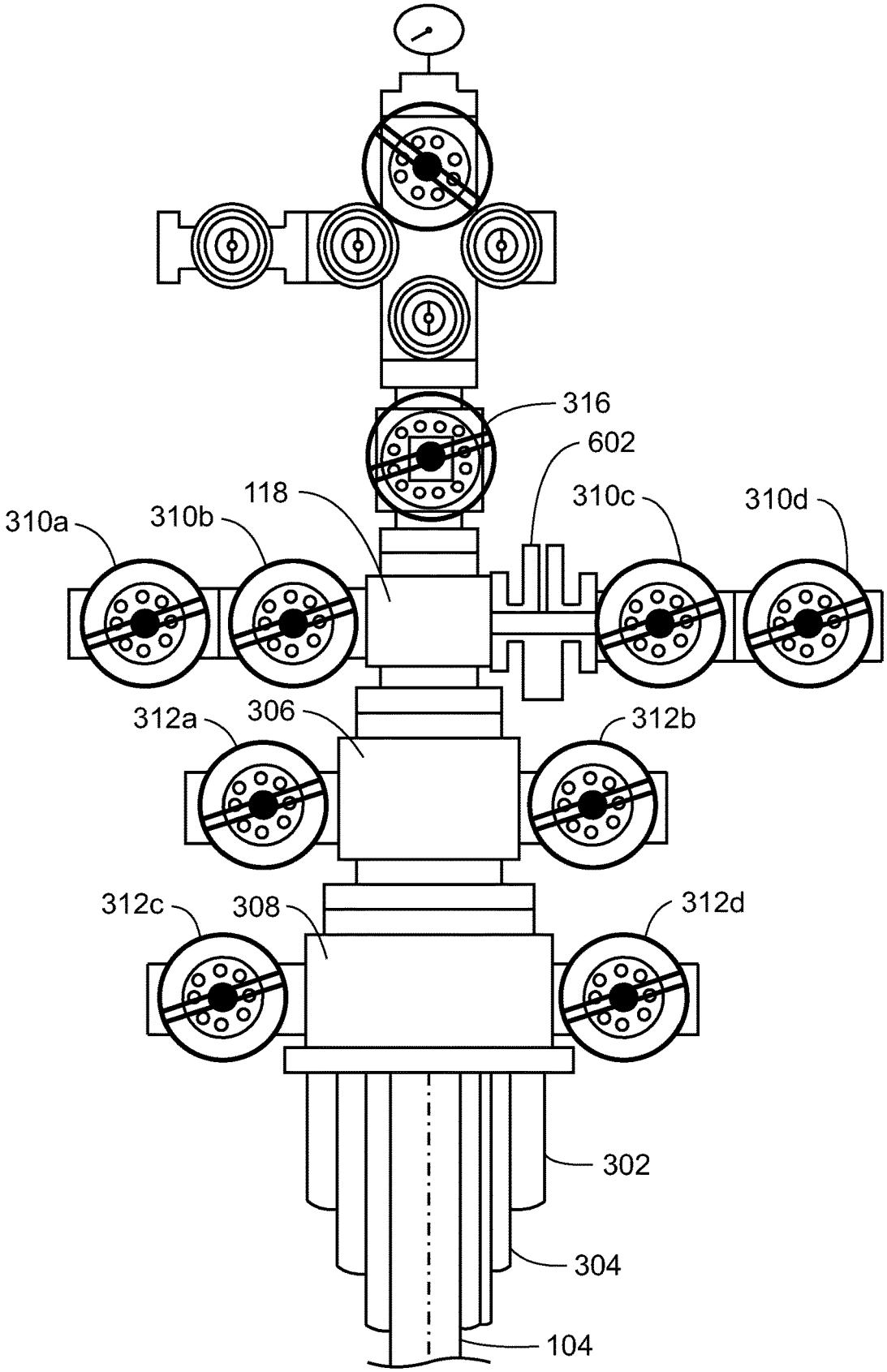
FIG. 6A is a schematic diagram of a wellhead including a tubing spool to which a second implementation of a wellbore chemical injection system is connected.
Figure 6B:
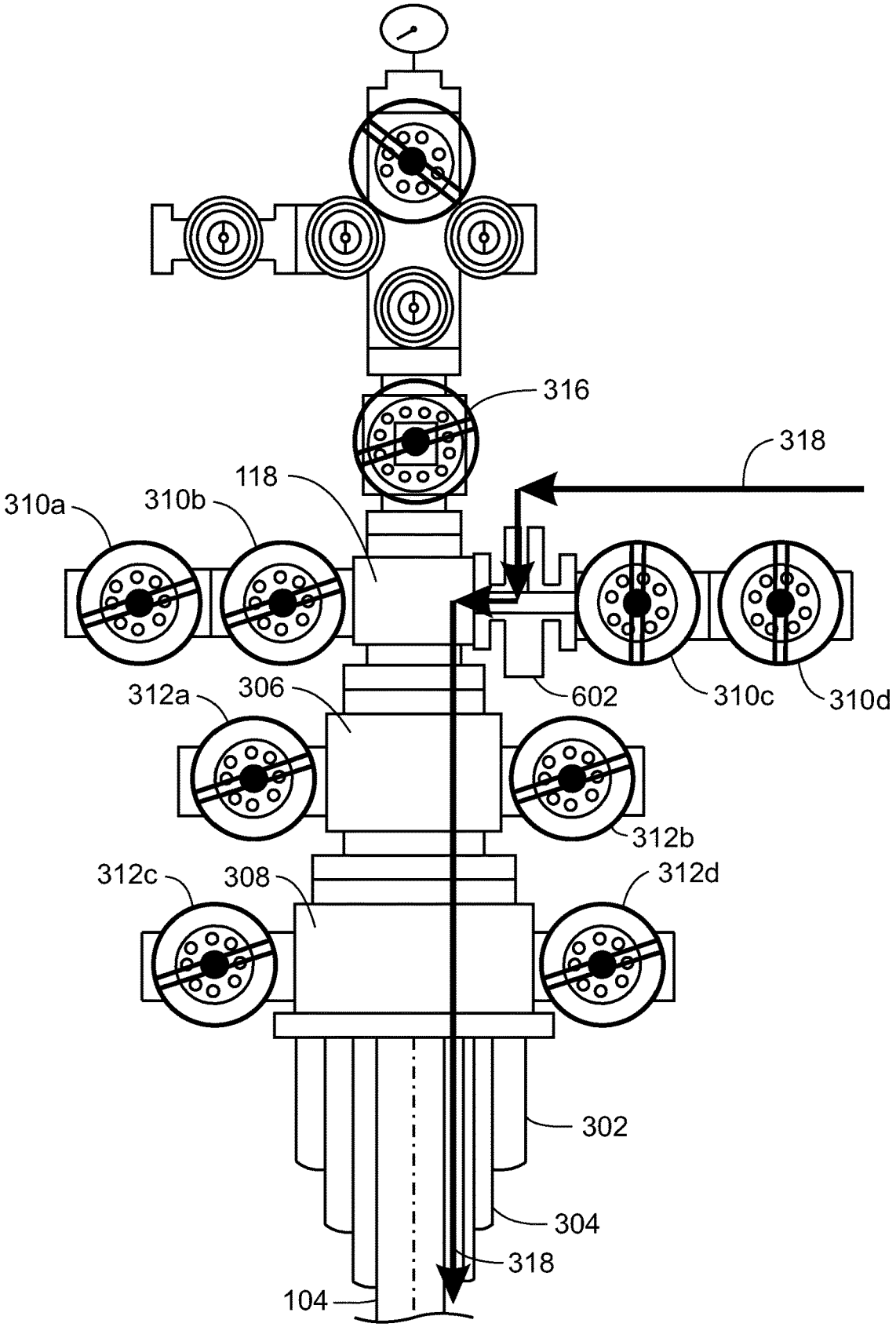
FIG. 6B is a schematic diagram of flowing chemicals through the wellbore chemical injection assembly of FIG. 6A.

FIG. 6A is a schematic diagram of a wellhead together with a Christmas tree including a tubing spool to which a second implementation of a wellbore chemical injection system is connected. The second implementation of the wellbore chemical injection system can include all components of the wellbore chemical injection system 200 (FIG. 2) except for the wellbore chemical injection assembly 102 (FIG. 2). Instead, the wellbore chemical injection system of FIG. 6A can include a different wellbore chemical injection assembly 602. As described below with reference to FIGS. 7A and 7B, the assembly 602 includes an extension member that extends from a sidewall of an extension flange, and that defines an opening through which chemicals are injected through the assembly 602. Thus, whereas the assembly 102 is constructed to flow chemicals from an axial end to an axial end of the extension flange, the assembly 602 is constructed to flow the chemicals through an inlet that is formed on the side wall of the extension flange such that the chemicals flow transverse to the longitudinal axis of the extension flange. FIG. 6B is a schematic diagram of flowing chemicals through the wellbore chemical injection assembly of 602. The arrows 604 schematically show the direction of injection and flow of the chemicals.

Figure 7A:
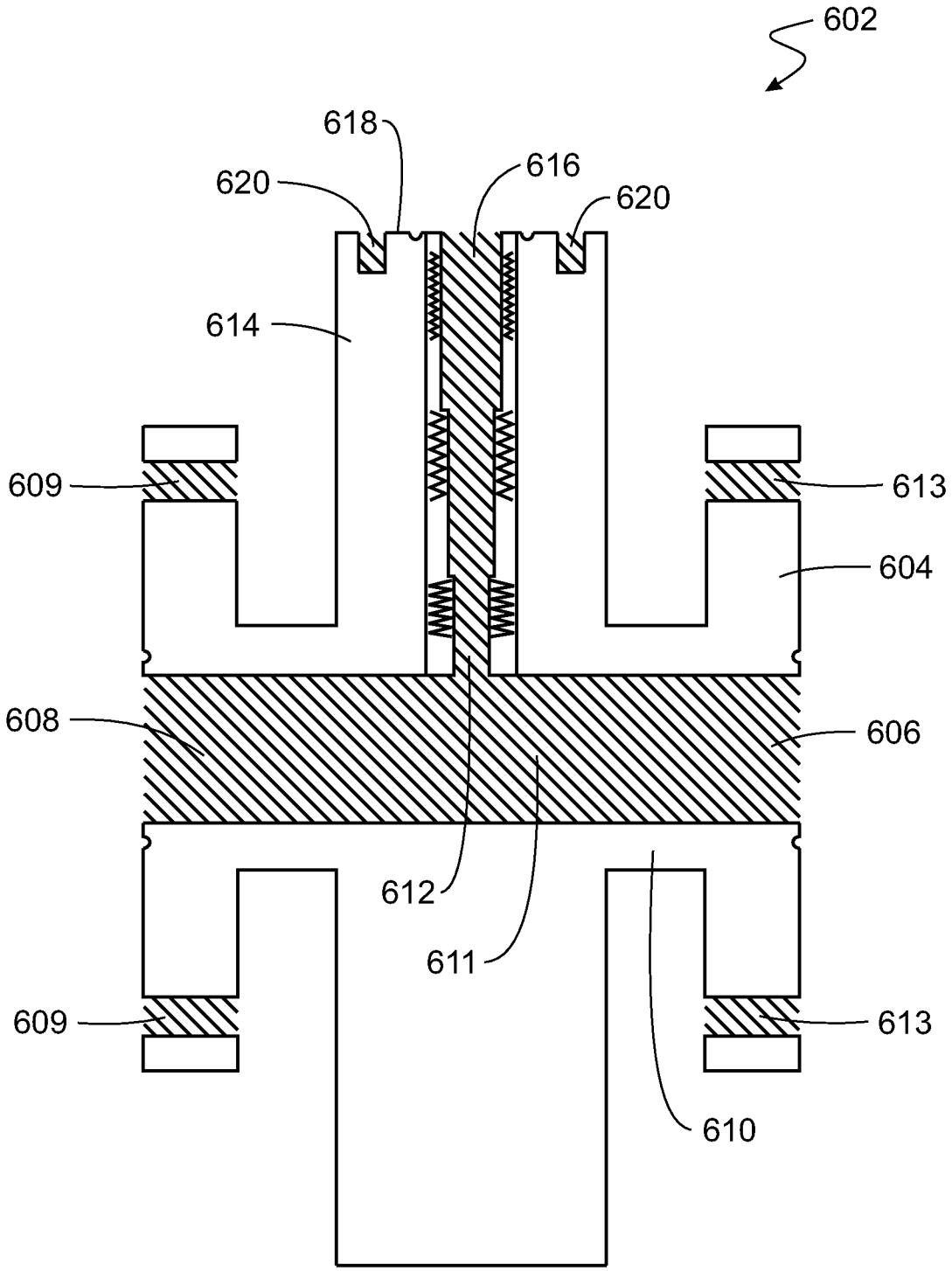
FIGS. 7A and 7B are schematic diagrams of the wellbore injection assembly implemented in the second implementation.
Figure 7B:
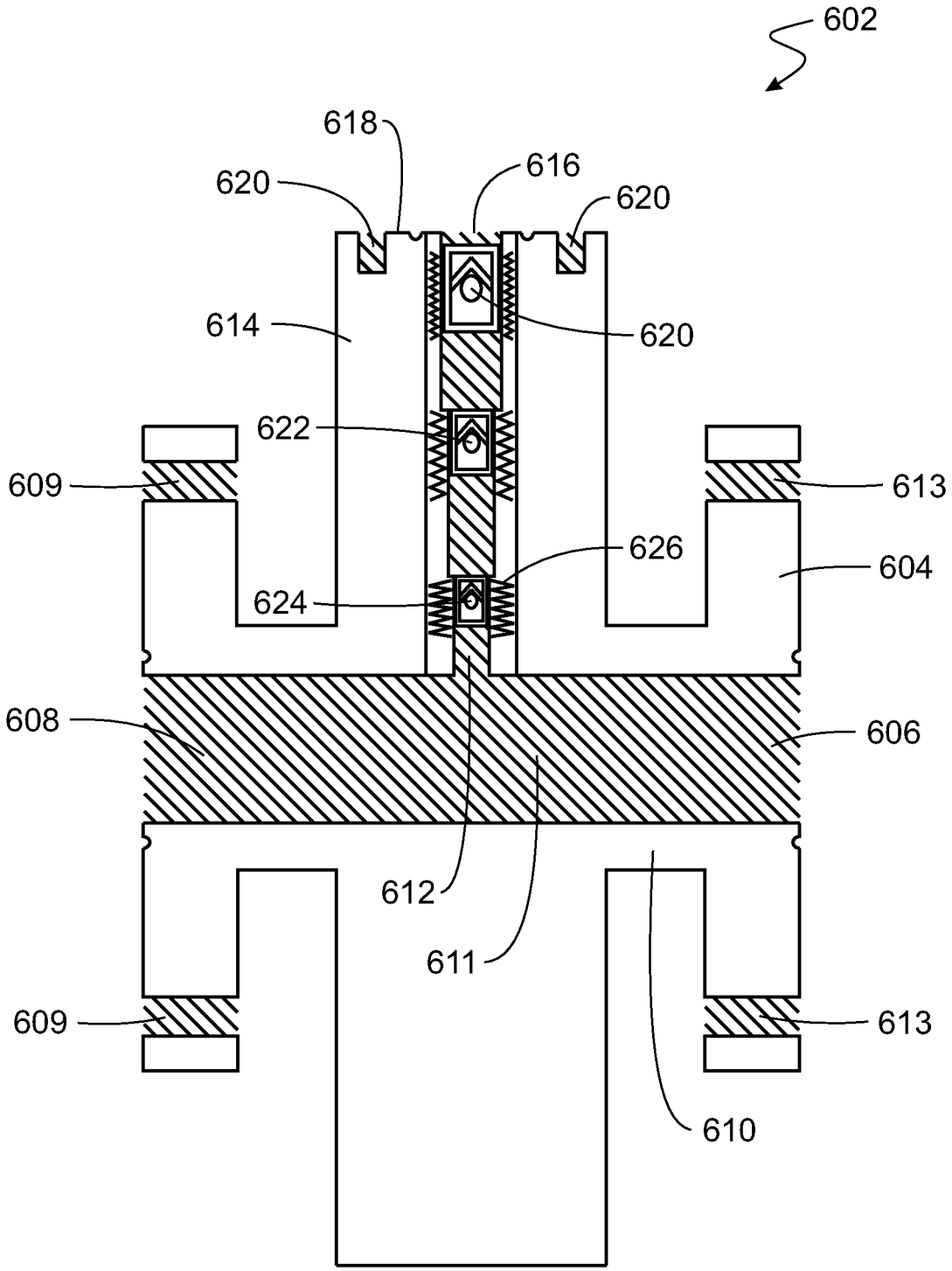

FIGS. 7A and 7B are schematic diagrams of the wellbore injection assembly 602. The assembly 602 includes an extension flange 604 that includes a first end 606 and a second end 608 opposite (i.e., axially opposite) the first end 606. The extension flange 604 includes a flange wall 610 between the first end 606 and the second end 608. The first end 604 is configured to be fluidically coupled to an inlet of a tubing spool (e.g., the tubing spool 118) of a wellhead (e.g., the wellhead 116) installed at a surface of a wellbore (e.g., the wellbore 100) formed through a subterranean zone (e.g., the zone 104). To do so, flange bolt holes 609 are formed on the second end 608 using which the assembly 602 can be bolted to the tubing spool 118. The second end 608 is configured to be fluidically coupled to a fluidic outlet of the wellhead, e.g., to gate valves 310*c*, 310*d* (FIG. 3A). To do so, flange bolt holes 613 are formed on the first end 604 using which the assembly 602 can be bolted to the gate valves 310*c*, 310*d*.

The extension flange 604 defines an inlet 612 on the flange wall 610. For example, the inlet 612 can be a through opening from an outer surface of the flange wall 610 to the interior opening (i.e., the flange bore 611) defined by the extension flange 604. In some implementations, the inlet 612 is formed equidistantly from the first end 604 and the second end 604. In some implementations, the inlet 612 can be nearer to one end than the other.

An extension member 612 is attached to the flange wall 610 at the inlet 612. For example, the extension member 612 can be a tubular structure made of the same material as the flange wall 610. The tubular structure can be attached (e.g., welded or manufactured directly into the flange body) to the flange wall 610 at the inlet 612 at a non-zero angle (e.g., substantially perpendicular or other non-zero angle) with respect to the flange wall 610. Like the flange bore 611 of the extension flange 604, the extension member 612 also defines an interior opening 616.

In some implementations, the interior opening 616 can have a uniform inner diameter along an axial length of the interior opening 616. In some implementations, the axial length of the extension member 614 can define a through opening of increasing inner diameter from the inlet 612 towards an end 618 of the extension member 614. The end 618 is configured to be fluidically coupled to a chemical reservoir (e.g., the chemical reservoir 202 (FIG. 2)) from which chemical is injected through the extension member 614 and the flange bore 611 of the extension flange 604 into the tubing spool 118. The end 618 can be coupled to the chemical reservoir with or without additional surface check valve or surface gate valve, which may be used between wellhead injection flange and chemical injection surface lines. The end face of the end 618 can include profiles (e.g., connection profiles) to fluidically couple the end 618 to the chemical reservoir, other components of the wellbore chemical injection system 202 (FIG. 2) or to a VR lubricator, as described earlier with reference to FIG. 4B.

As shown in FIGS. 7A and 7B, the assembly 602 includes multiple valves (e.g., valves 620, 622, 624) in the through opening 616 of the extension member 614. The valve 620 is an inner valve installed nearest to the inlet 612 formed on the flange wall 610 and farthest from the end 618. The valve 624 is an upper valve installed nearest to the end 618 and farthest from the inlet 612. The middle valve 622 is installed equidistantly from the valve 620 and the valve 624. Each of the multiple valves is a check valve that seals to the inner wall of the through opening 616 and prevents fluid flow in only one direction, i.e., from the end 618 to the inlet 612.

In some implementations, the multiple valves are sized differently to seal the through opening 614 of increasing diameter. For example, an outer diameter of each of the multiple valves can be different and can be sized to match an inner diameter of the location in the through opening 614 in which the respective valve is installed. In implementations in which the through opening 616 is sized to have a decreasing inner diameter along the axial length from the inlet 612 to the end 618, the outer diameter of the valve 620 can be sized so that the valve 620 can be seated near the inlet 612 where an inner diameter of the through opening 614 is the narrowest. The outer diameter of the valve 622 can be greater than that of the valve 620, and the outer diameter of the valve 624 can be greater than that of the valve 622. In this manner, each valve can be sized to be seated to seal along an axial length of the extension member 614.

In implementations in which the through opening 616 has a uniform inner diameter along its length from the inlet 612 to the end 618, a valve 626 can be installed within the through opening 616, for example, in a manner similar to which the valve 424 (FIG. 4A) was installed within the interior opening 420 (FIG. 4A) of the mandrel 414 (FIG. 4A) using coupling threads and sealing elements. In such implementations, the through opening 616 can be formed to have decreasing inner diameter along an axial length of the through opening 616 from the inlet 612 to the end 618. The valves 620, 622, 624 can be installed in the interior opening defined by the through opening 616 along the axial length of the through opening 616.

Figure 8A:
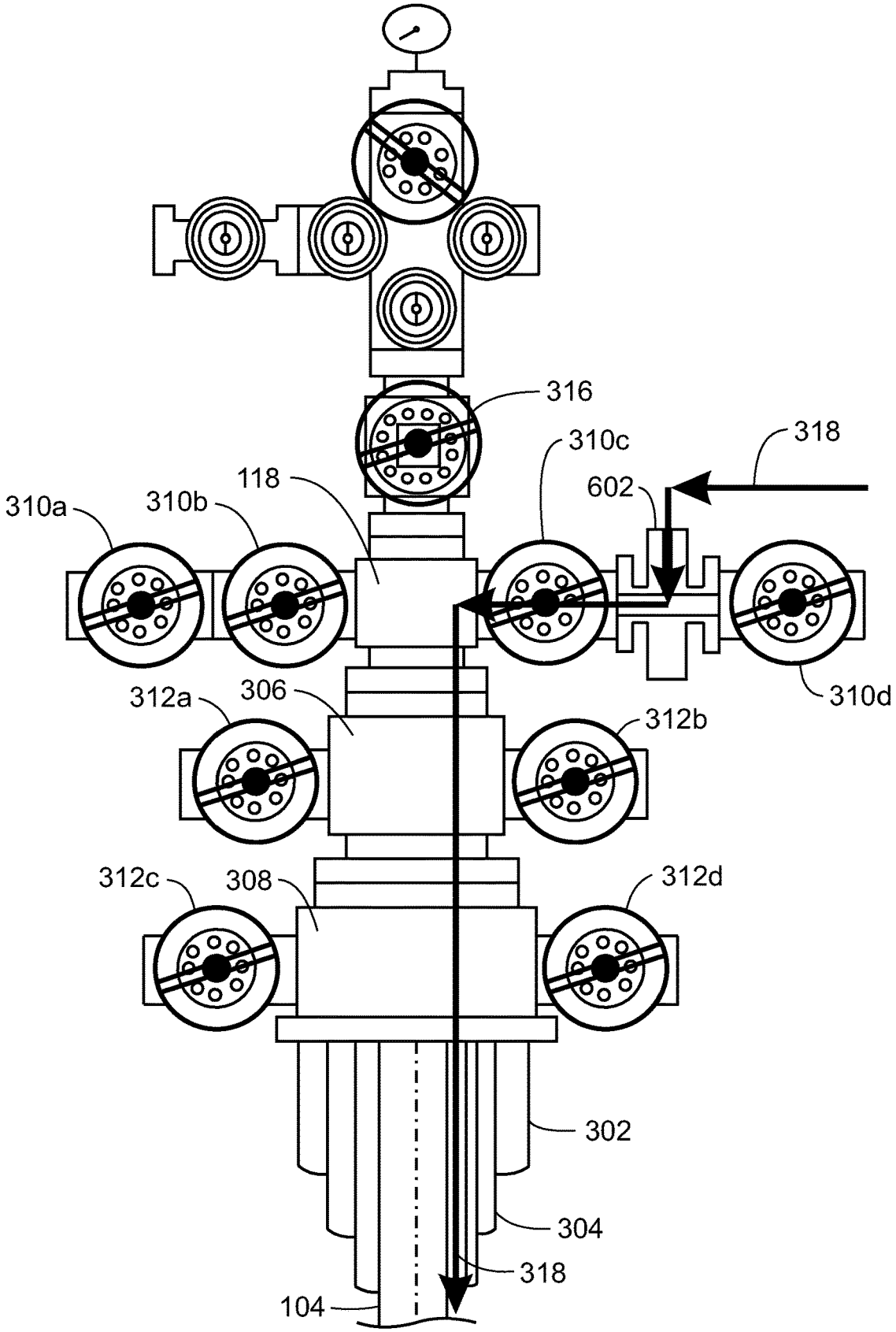
FIGS. 8A, 8B and 8C are different arrangements implementing the second implementation.
Figure 8B:
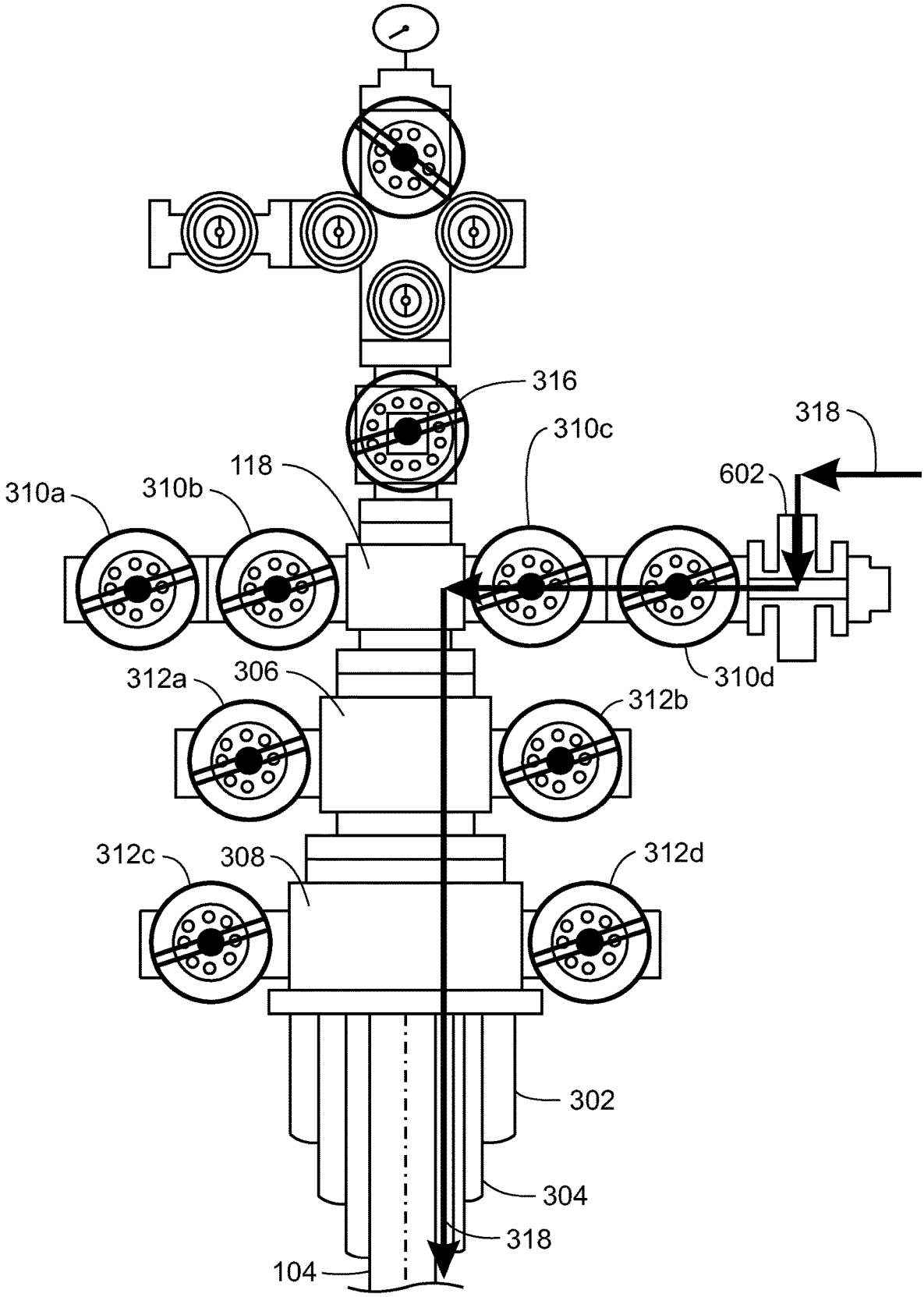
Figure 8C:
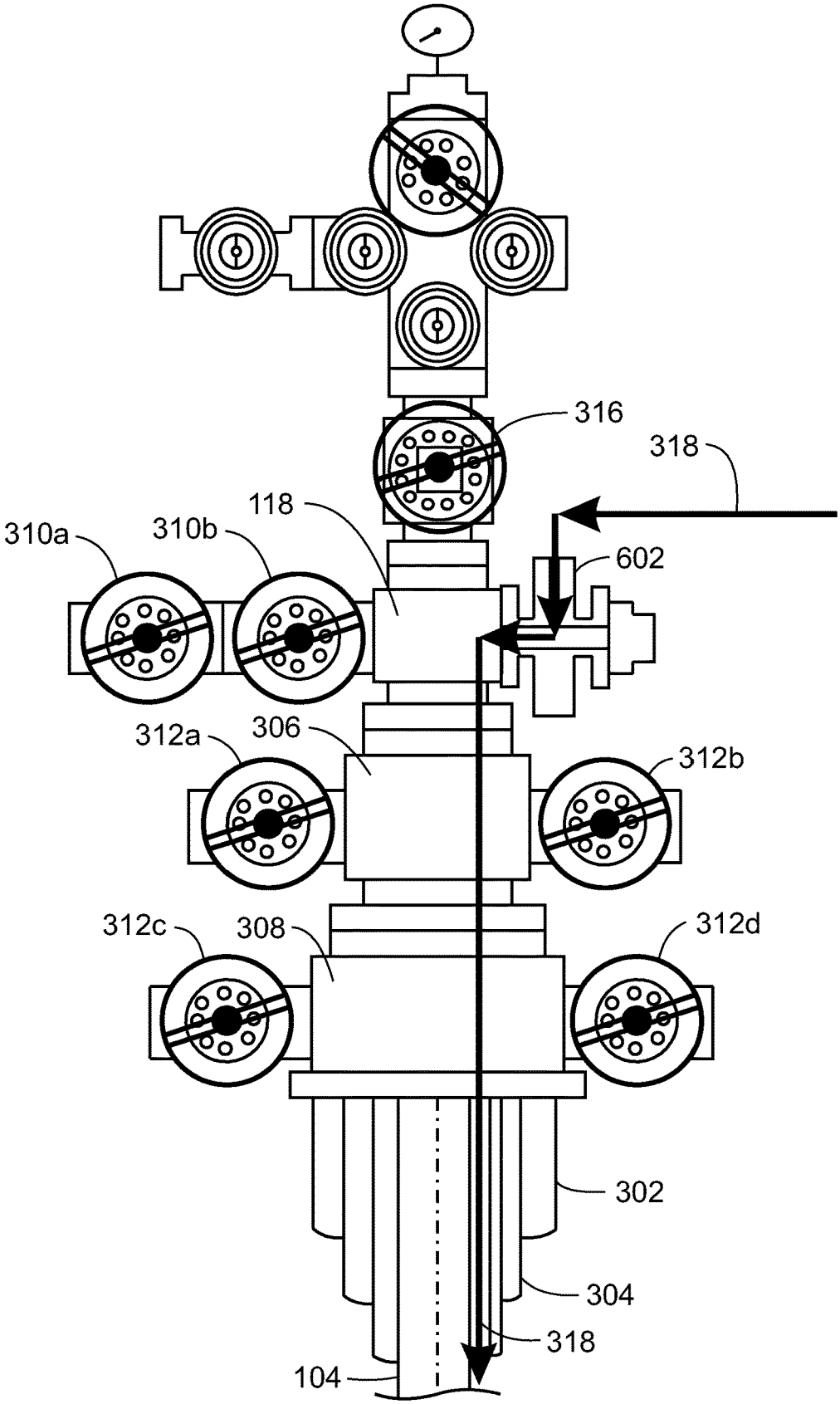

FIGS. 8A, 8B and 8C are different arrangements implementing the assembly 602. In the arrangement of FIG. 8A, the assembly 602 is installed between the gate valves 310*c* and 310*d*. In this arrangement, an outlet of the gate valve 310*c* is fluidically coupled to an inlet of the tubing spool 118. The end 608 of the assembly 602 is fluidically coupled to an outlet of the gate valve 310*c*. The end 606 of the assembly 602 is fluidically coupled to an outlet of the gate valve 310*d*. The inlet of the gate valve 310*d* can be closed to fluid flow or coupled to an interface that allows fluidically coupling the inlet of the gate valve 310*d* to other flow equipment.

In the arrangement of FIG. 8B, the gate valves 310*c* and 310*d* are installed between the inlet to the tubing spool 118 and the assembly 602. In such an arrangement, the end 608 of the assembly 602 can be fluidically coupled to the inlet to one of the gate valves, and the end 606 can be closed to fluid flow or coupled to an interface that allows fluidically coupling the end 606 to other flow equipment. In the arrangement of FIG. 8C, the gate valves are omitted, and the end 606 is closed to fluid flow. In all the arrangements that implement the assembly 602, the chemicals are injected through the end 618 of the extension member 614 such that the chemicals flow transverse to the interior opening 611 for the length of the extension member 614, and then flows along a longitudinal axis of the interior opening 611 prior to flowing into the tubing spool 118.

Figure 9:
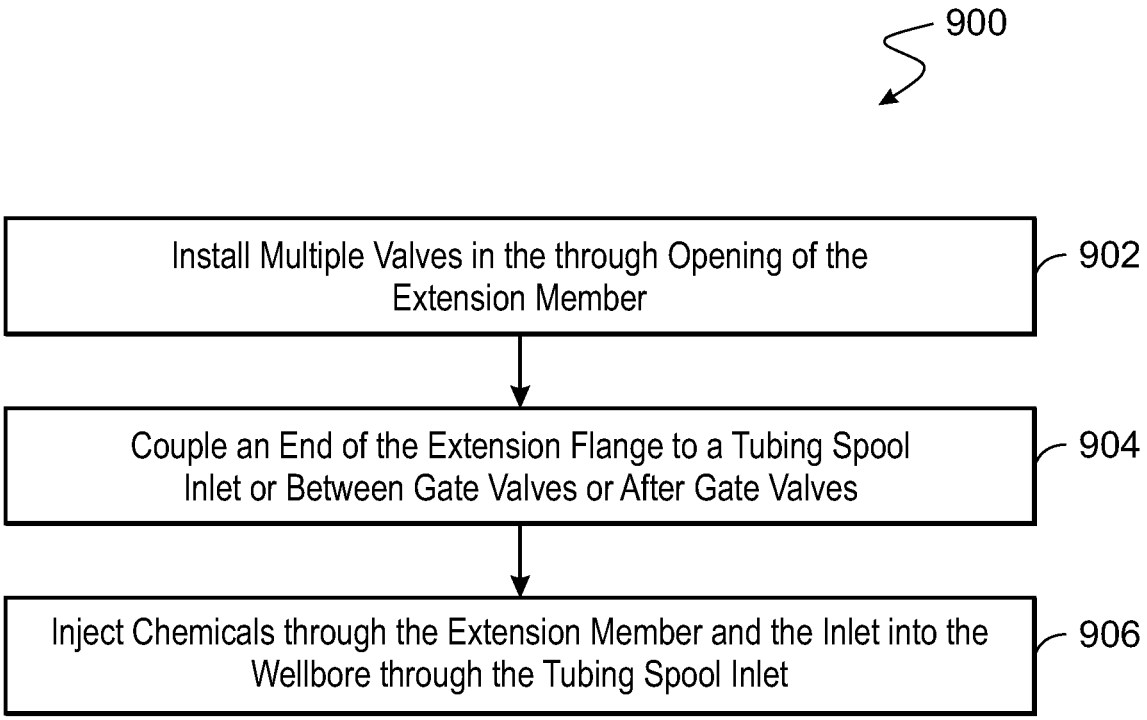
FIG. 9 is a flowchart of an example of a process of implementing the wellbore chemical injection assembly of FIG. 6A.

FIG. 9 is a flowchart of an example of a process 900 of implementing the wellbore chemical injection assembly 602. The process 900 can be implemented by a well operator. At 902, multiple valves (e.g., valves 620, 622, 624) are installed in the through opening of the extension member 614. At 904, an end of the extension flange is coupled to a tubing spool inlet or between gate valves or after gate valves. At 906, chemicals are injected through the extension member 614 and the inlet 612 into the wellbore 100 through the inlet to the tubing spool 118.

In some implementations, the valve 626 is installed in the through opening of the extension member 614. The valve 626 has increasing inner diameters from the inlet 612 towards the end 616 of the extension member 616. The multiple valves are installed in the flange body. During operation, if a chemicals leak is detected in the valve 626, then the injection of chemicals through the extension member 614 is ceased, e.g., by turning off the HP pump 206 (FIG. 2). Then, the valve assembly can be removed from within the through opening of the extension member 614. If there are two gate valves between chemical injection flange and tubing spool, then both gate valves are closed and the trap pressure is bled. After that, the flange is removed, and the check valves are safely replaced for installation. In particular, the valve assembly can be removed without needing to de-couple the extension flange 604 from the gate valves 310*c*, 310*d*.

Thus, particular implementations of the subject matter have been described. Other implementations are within the scope of the following claims.

The invention claimed is:

1. A wellbore chemical injection assembly comprising:

an extension flange comprising a first end and a second end opposite the first end, the extension flange comprising a flange wall between the first end and the second end, the extension flange defining an inlet on the flange wall, the first end configured to be fluidically coupled to a tubing spool inlet of a wellhead installed at a surface of a wellbore formed through a subterranean zone, the second end configured to be fluidically coupled to a fluidic outlet of the wellhead;

an extension member attached to the flange wall at the inlet at a non-zero angle with respect to the flange wall, an axial length of the extension member defining a through opening of increasing inner diameter from the inlet towards an end of the extension member, the end configured to be fluidically coupled to a chemical reservoir from which chemical is injected through the extension member and the extension flange into the tubing spool; and a plurality of valves seated in the through opening of the extension member, the plurality of valves sized differently to seal the through opening of increasing inner diameter.

2. The assembly of claim 1, wherein the extension member is perpendicular to the flange wall.

3. The assembly of claim 2, wherein the opening is formed equidistantly from the first end and the second end.

4. The assembly of claim 1, wherein the plurality of valves comprises:

a first valve having a first outer diameter installed in a portion of the through opening near the inlet, wherein the portion at which the first valve is installed has a first inner diameter;

a second valve having a second diameter greater than the first diameter and installed in a portion of the through opening having a second inner diameter greater than the first inner diameter, the first valve installed between the second valve and the inlet; and a third valve having a third diameter greater than the second diameter and installed in a portion of the through opening having a third inner diameter greater than the second inner diameter, the third valve installed between the end of the extension member and the second valve.

5. The assembly of claim 4, wherein each of the plurality of valves is removably installed within the extension member.

6. The assembly of claim 5, wherein the end of the extension member comprises a face, wherein the face defines profiles to couple the extension member to a pressure lubricator configured to remove the plurality of valves from within the extension member.

7. A method comprising:

attaching an extension member to an inlet in a flange wall between a first end and a second, opposite end of an extension flange, the extension member attached at a non-zero angle with respect to the flange wall, an axial length of the extension member defining a through opening from the inlet to the end of the extension member, the extension flange defining a flow pathway from the first end to the second end, the flow pathway configured to received fluid through the extension member;

installing a plurality of valves in the through opening of the extension member;

coupling the first end of the extension flange to a tubing spool inlet of a wellhead installed at a surface of a wellbore formed through a subterranean zone; and injecting chemicals through the extension member and the inlet into the wellbore through the tubing spool inlet.

8. The method of claim 7, wherein installing the plurality of valves in the through opening comprises forming the through opening to increasing inner diameters from the inlet towards the end of the extension member.

9. The method of claim 8, wherein installing the plurality of valves comprises:

installing a first valve having a first outer diameter in a portion of the through opening near the inlet, wherein the portion at which the first valve is installed has a first inner diameter;

installing a second valve having a second diameter greater than the first diameter in a portion of the through opening having a second inner diameter greater than the first inner diameter, wherein the first valve is installed between the second valve and the inlet; and installing a third valve having a third diameter greater than the second diameter in a portion of the through opening having a third inner diameter greater than the second inner diameter, wherein the third valve is installed between the end of the extension member and the second valve.

10. The method of claim 8, further comprising:

determining a chemicals leak in the plurality of valves; and in response to determining the chemicals leak in the plurality of valves:

ceasing injecting the chemicals; and removing the plurality of valves from within the extension member.

11. The method of claim 10, wherein removing the plurality of valves from within the extension member comprises:

coupling a pressure lubricator to an end face of the end of the extension member; and removing the plurality of valves by operating the pressure lubricator.

12. The method of claim 7, further comprising coupling the second end of the extension flange to a fluidic outlet of the wellhead.

13. The method of claim 12, wherein injecting the chemicals through the extension member and the inlet into the wellbore through the tubing spool inlet comprises closing the fluidic outlet of the wellhead before injecting the chemicals.

14. The method of claim 13, wherein the fluidic outlet of the wellhead comprises a plurality of gate valves, wherein closing the fluidic outlet comprises closing the gate valves.

* * * * *